United States Patent [19]

Telling

[11] 4,275,650

[45] Jun. 30, 1981

[54] COMPACTING APPARATUS

[75] Inventor: Edward F. Telling, Worthing, England

[73] Assignee: Trewhella Brothers (UK) Ltd., Great Britain

[21] Appl. No.: 109,991

[22] Filed: Jan. 7, 1980

Related U.S. Application Data

[62] Division of Ser. No. 927,531, Jul. 24, 1978, Pat. No. 4,213,384.

[30] Foreign Application Priority Data

| | | | |
|---|---|---|---|
| Jul. 26, 1977 | [GB] | United Kingdom | 31402/77 |
| Oct. 14, 1977 | [GB] | United Kingdom | 42925/77 |
| Feb. 3, 1978 | [GB] | United Kingdom | 04530/78 |
| Feb. 14, 1978 | [GB] | United Kingdom | 05764/78 |
| Apr. 6, 1978 | [GB] | United Kingdom | 13597/78 |
| Apr. 18, 1978 | [GB] | United Kingdom | 15102/78 |

[51] Int. Cl.[3] ..... B30B 15/30

[52] U.S. Cl. ..... 100/45; 100/DIG. 2; 100/74; 100/98 R; 100/209; 100/215; 100/218; 100/295

[58] Field of Search ..... 100/DIG. 2, 245, 98R, 100/98 A, 74, 116, 108, 215, 295, 218, 209, 45; 241/99; 222/82, 87, 88

[56] References Cited

U.S. PATENT DOCUMENTS

| | | | |
|---|---|---|---|
| 1,998,263 | 4/1935 | Townsend | 222/87 |
| 2,139,143 | 12/1938 | Wiswell | 222/87 |
| 2,346,561 | 4/1944 | Delay | 100/108 |
| 2,654,308 | 10/1953 | Millard | 100/98 A |
| 2,737,995 | 3/1956 | Jennings | 100/DIG. 2 |
| 3,024,720 | 3/1962 | Welsh | 100/DIG. 2 |
| 3,993,221 | 11/1976 | Boynton | 100/98 R |

FOREIGN PATENT DOCUMENTS

| | | | |
|---|---|---|---|
| 533296 | 9/1955 | Italy | 100/108 |

*Primary Examiner*—Billy J. Wilhite

*Attorney, Agent, or Firm*—Roylance, Abrams, Berdo & Farley

[57] ABSTRACT

A double-acting compacting apparatus comprises two movable compaction plates and a stationary compaction plate arranged between said movable plates. Arranged between respective ones of said movable plates and said stationary plate is a free-fall aperture through which compacted objects can fall under gravity. Means are provided for connecting the movable plates together such that during a compaction stroke utilizing one of said movable plates the other of said movable plates defines with said stationary plate a space for receiving further material to be compacted.

13 Claims, 9 Drawing Figures

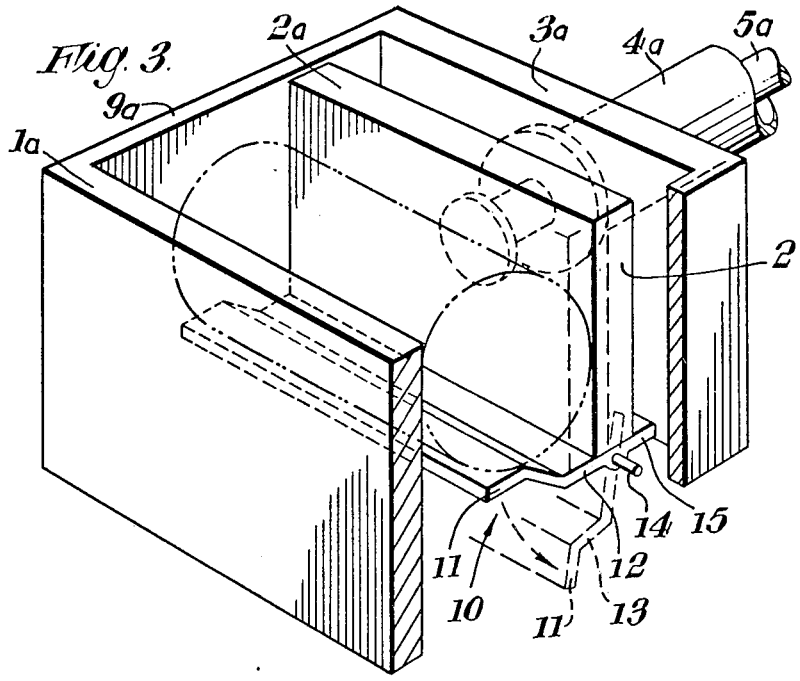
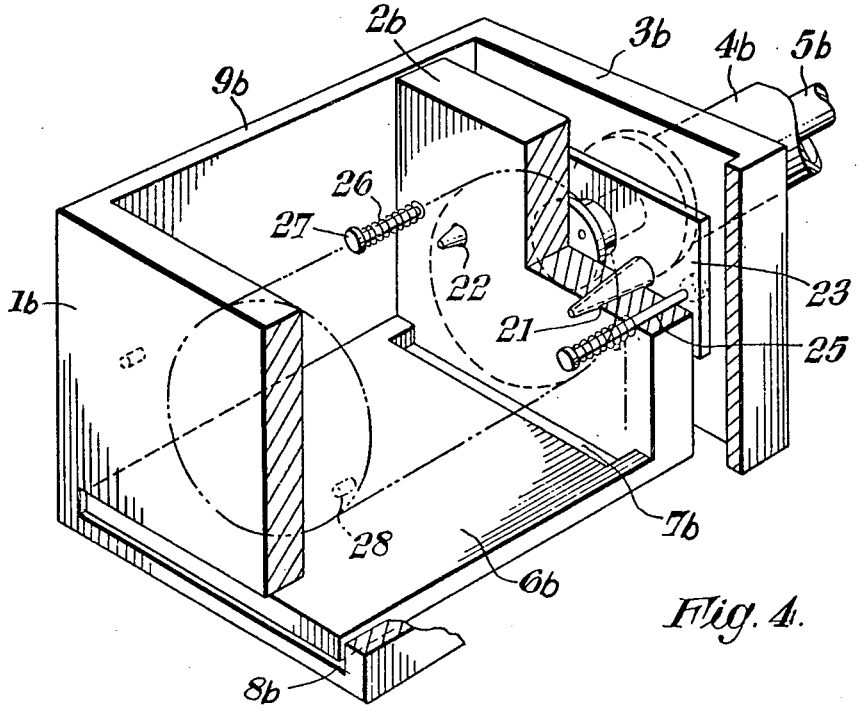
Fig. 4.

COMPACTING APPARATUS

This is a division of application Ser. No. 927,531, filed July 24, 1978, now U.S. Pat. No. 4,213,384 issued July 22, 1980.

The present invention relates to compacting apparatus. The term compacting apparatus as used here and in the following is meant also to include crushing apparatus such as those used to break and crush bottles and other brittle containers.

An object of the present invention is to provide a compacting apparatus in which objects, such as tin cans, bottles and like waste, can be compacted or crushed in an easy and efficient manner.

A further object of the present invention is to provide such a compacting apparatus in which a compacted object or objects is or are permitted to fall freely from the apparatus.

Yet another object of the invention is to provide such a compacting apparatus in which objects to be compacted, such as cans and drums, are fed automatically to the apparatus in a timed sequence and in a particular orientation with regard to the feed orifice of the apparatus.

The compacting apparatus of the present invention comprises at least one first compacting plate; at least one second compacting plate arranged for reciprocating movement relative said at least one first compacting plate; means for moving one of said plates relative to the other; and free-fall means arranged adjacent one of said plates to permit a compacted object to fall freely from said apparatus. The means for causing said relative movement of the first and second compacting plates may comprise any suitable, reciprocating prime mover, such as a piston and cylinder arrangement, arranged to co-operate with a respective one of said plates for movement thereof along a compacting path.

For the purpose of supporting an object to be crushed or compacted between the mutually opposing faces of the first and second compacting plates, the plates may be arranged to co-operate with a floor means which will define an aperture through which a compacted object is able to fall freely, e.g. into a container placed beneath said aperture. Alternatively, the floor can be omitted and the object supported by a pivotable device which in one position will support an object generally centrally between said mutually opposing faces until the object is held firmly therebetween, whereupon the pivotable device will swing away to permit the object to fall freely through the gaps between said mutually opposing faces and be returned to its supporting position upon the return movement of the movable plate.

Conveniently, feed means are provided for feeding objects into the compacting space formed between the movable plate and the stationary plate in the starting positions of said plates. This object-feeding means may have the form of a hopper arrangement, with the objects being fed to the apparatus in a selected time sequence corresponding to the speed at which the movable plate carries out a compacting operation, or may be arranged to fall freely from said hopper into said space, in which case the movable plate is provided with a tail or support surface extending outwardly of and at an angle to said movable plate, an object falling from the hopper being held by the tail until the movable plate is returned to its starting position, whereupon said object is able to fall into the compacting space between said plates. It will be understood that the tail plate can be provided with means for aligning the object in a given relationship relative to the direction of movement of said movable plate.

When the compacting apparatus is to be used to crush bottles or other brittle objects, one of the plates may have arranged on the surface thereof facing the other of said plates a plurality of pegs which, during a crushing operation are arranged to be received in respective ones of a plurality of through-holes arranged in the other of said plates. In this way, powdered material, such as powdered glass is prevented from building-up adjacent the compacting plates and thus impairing the efficiency of the apparatus.

When the objects to be compacted are tin cans, for example, one of the two mutually opposing surfaces of said plates may be provided with an axially displaceable can-piercing device. A compacting apparatus thus constructed can be used to pierce a liquid-filled can and to drain it of its contents as the can is being compacted. The piercing device is arranged such that it will be automatically withdrawn from the compacted can just prior to the termination of a compacting operation, so that the compacted can is able to fall through said free-fall aperture.

The described compacting apparatus may be joined to a similar compacting apparatus to form a so-called tandem compacting apparatus. In this case the compacting apparatus may comprise at least one first compacting plate and at least one second compacting plate attached to and spaced from said at least one first compacting plate; at least one third compacting plate arranged intermediately of said first and said second compacting plates; said at least one first compaction plate and said at least one second compaction plate being arranged for rectalinear movement relative said at least one third plate; means for providing said rectalinear movement; and a free-fall aperture adjacent each of said at least one first and said at least one second compacting plate. The first compacting plate and the second compacting plate are rigidly connected together by wall means extending therebetween and when the object-support means has the form of a floor means, said floor means may extend between said first and said second plates to terminate at a given distance therefrom to define a respective gap therewith. The compacting unit comprising the first compacting plate, the second compacting plate, the connecting walls and, optionally the floor means may be arranged for reciprocating movement, towards and away from the intermediate, in this case stationary compacting plate. In this case, the unit may be driven by a single prime mover arranged to co-operate with one of the said plates to cause said reciprocating movement. Alternately, a prime move may be arranged to co-operate with each of said first and said second plates.

When objects are to be compacted on a large scale the compacting apparatus may be arranged to receive a relatively large number of objects in random orientation and to this end each of the compacting plates will have a substantially trapezoidal configuration with the shorter of the parallel sides being located at the top of the plate, so that two adjacent plates define a downwardly flared space therebetween. Since the compacted objects may tend to be held against the sides of respective compacting plates subsequent to a compacting operation by, e.g. frictional forces, means may be provided for initiating the free fall of the compacted objects through said free-fall orifice.

The apparatus may also be used to compact bulk waste, such as domestic waste, sewage tailings or factory waste, e.g. polystyrene waste, to a high-degree of compaction, in which case the free-fall aperture will cooperate with means for automatically closing and opening the aperture at given times during a working operation. Walls provided to contain the waste in the apparatus will have drain means for the egress of liquid, or may be of a strong porous material. Means may be provided to wet the waste with a liquid substance to reduce the resistance of the waste to compaction, which wetting agent may be mixed with a binder to bind the compacted waste together.

Conveniently a plurality of said single-compacting apparatus or said double-acting compacting apparatus may be arranged in line and/or in side-by-side relationship to form a compacting plant in which the respective compacting apparatus may be arranged to receive objects of the same or similar type, or may be arranged to receive objects for compaction or crushing of differing types.

So that the invention will be more readily understood and optional features thereof made apparent, exemplary embodiments of the invention will now be described with reference to the accompanying schematic drawings, in which:

FIG. 3 illustrates in perspective one embodiment of a device for supporting an object for compaction substantially centrally between the opposing faces of two compacting plates;

FIG. 4 is a perspective view, partly in section, of one embodiment of a can-piercing device;

Figure 1:
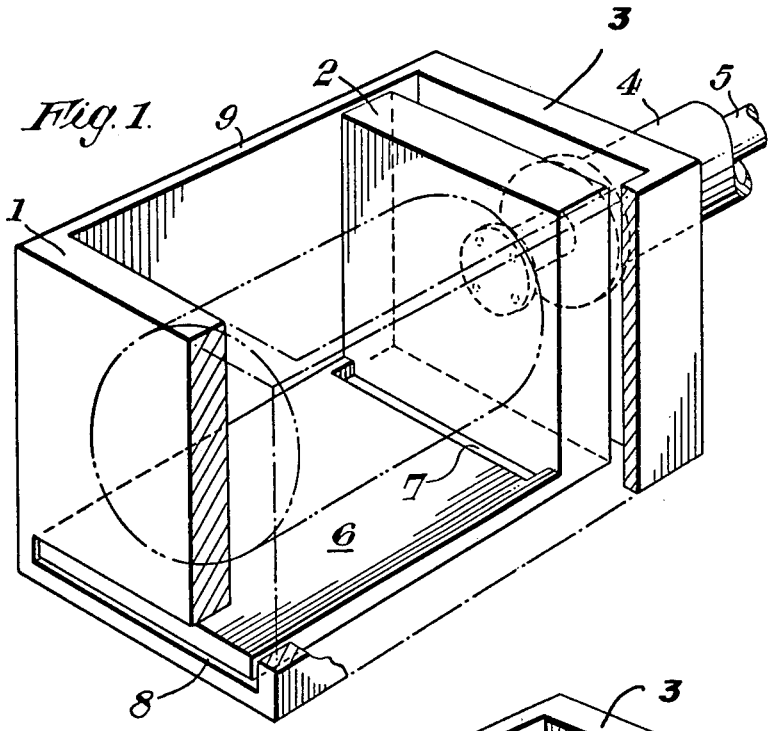
FIG. 1 is a perspective view, partly in section, of a single compacting apparatus with the movable compacting plate in its starting position.
Figure 2:
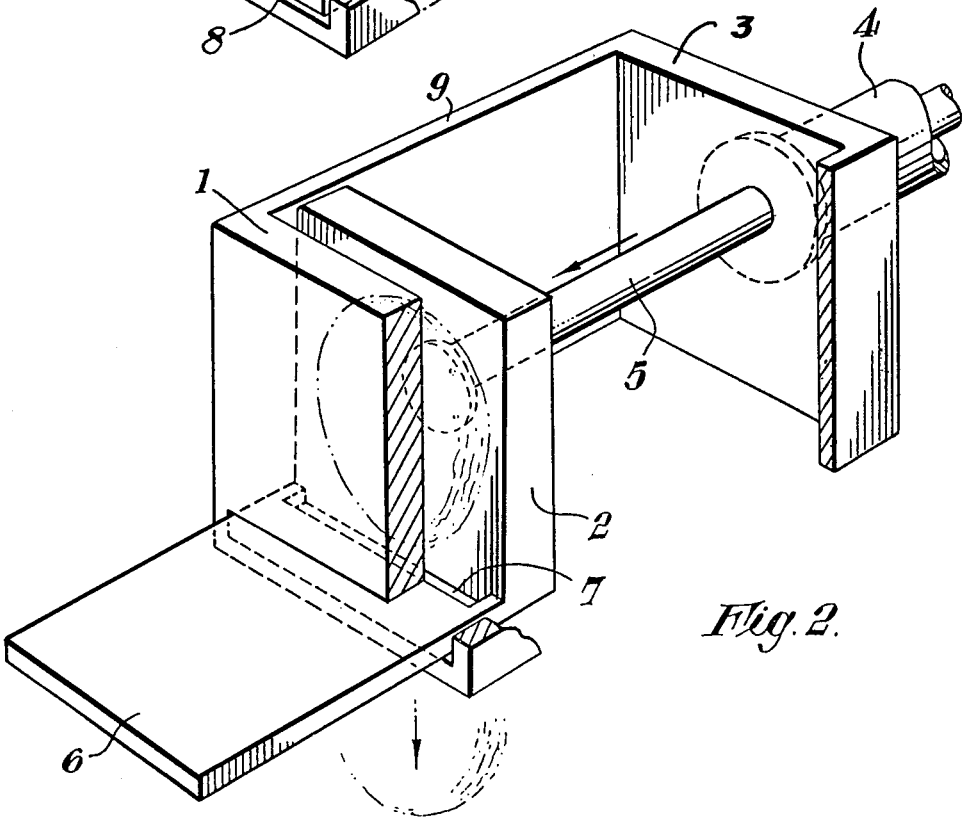
FIG. 2 is a view similar to that of FIG. 1 with the movable compacting plate in its final compacting position.

In FIGS. 1 and 2 there is illustrated a single compacting apparatus comprising a stationary compacting plate 1 and a compaction plate 2 which is arranged for reciprocating movement, towards and away from said stationary plate 1. The stationary compacting plate 1 is rigidly connected by means of ties or wall means 9 to an end wall 3 on which there is mounted a cylinder 4 in which a piston 5 is arranged for axial movement. One end of the piston extends through an aperture in the wall 3 and is connected to the movable compacting plate 2 in order to move said plate towards and away from said stationary plate 1. In the illustrated embodiment the movable compacting plate 2 has connected thereto an object-support means in the form of a floor 6 having an elongate free-fall aperture 7 arranged therein adjacent the plate 2. The longitudinal axis of the aperture 7 is parallel with the longitudinal axis of the plate 2, as seen in the Figure, and the length and width of the aperture is determined by the size of the objects to be compacted and the degree of compaction to which they are to be subjected. The stationary compacting plate 1 is provided with a slot 8 through which the floor 6 can pass as the plate 2 approaches the stationary plate 1.

FIG. 2 illustrates the position of the movable plate 2 relative to the stationary plate 1 at the end of a compacting stroke of the piston 5, the floor 6 having passed through slot 8 to an extent such that the aperture 7 is located immediately beneath the compacted object, thereby enabling the compacted object to fall freely through said aperture and away from said apparatus, as illustrated by the compacted can shown in ghost lines.

When compacting, for example, large cylindrical cans or drums, it may be more convenient to compact the cans or drums sideways on, i.e. with a long axis of the can or drum extending parallel to the long axis of the free-fall aperture, thereby reducing the necessary length of working stroke. Although a large can or drum can be compacted sideways on by means of the illustrated apparatus with floor 6 and free-fall aperture 7, the compacted can will, in this case, often exhibit a lip which will render uniform stacking of the can and, when the apparatus is also to be used to empty the can as hereinafter described, the complete emptying thereof more difficult. Consequently, it may be more convenient to support the can generally centrally of the plates 1 and 2, i.e. to omit the floor 6 and to support the can by some other, retractable means. An example of alternative support means is shown in FIG. 3. This Figure shows, in perspective the stationary plate 1*a* connected by side walls 9*a* to the end wall 3*a*. In this embodiment the support floor 6 has been omitted and the object for compaction is instead supported by a pivotable device generally shown at 10. The support device of the FIG. 3 embodiment is substantially of Z-shaped configuration when seen in cross-section having a limb 11, a further limb 12 and a member 13 connecting said limbs together. The device 10 is pivotally mounted at 14, the pivot being located beneath the movable plate 2*a* in the starting position of said plate. Thus, the supporting device 10 will be held in its object-supporting position by the movable plate 2*a*. As the plate 2*a* moves forward the object to be compacted is gripped between the plates 1*a* and 2*a* and the plate 2*a* will move away from the pivot 14 so that the limb 11 is able to pivot out of the path of the object to be compacted. The plate 2*a* then advanced the full working stroke of the piston 5*a*, the free-fall aperture in this case being the opening defined by the mutually opposing surfaces of the plates 1*a* and 2*a*. The non-supporting position of the pivotable device 10 is shown in ghost lines in FIG. 3, from which it can be seen that the limb 12 has a portion 15 which projects into the rearward movement path of the plate 2*a*. Thus, as the piston 5 is retracted and the plate 2*a* moved to its starting position, in readiness for a further compacting operation, an edge of the plate 2*a* bears against said portion 15, pivoting the device 10 into its object-supporting position, said device being unable to swing from this position by virtue of the fact that the bottom of plate 2*a* is located immediately above the pivot 14.

As beforementioned, the compacting apparatus of the present invention can be used to drain a liquid-filled can in conjunction with the compaction of the same.

FIG. 4 shows one embodiment of a can-piercing device mounted, in this case, on the plate 2*b*. The illustrated device comprises two spikes 21, each of which is arranged to pass through an opening 22 in the movable plate 2*b* and is connected to a carrier 23. Each carrier 23 is connected to the plate 2*b* by means of a respective stud 25 passing therethrough. One end of the stud 25 is fixed to the carrier 23, as by welding for example, while the other end of the stud has mounted thereon a plate 27. Extending, under slight compression, between the plate 27 and the opposing face of plate 2*b* is a coil spring 26 biasing the carrier 23 towards said plate 2*b*. The strength of the spring 26 is sufficient to prevent its associated spike from being displaced axially to any great extent by means of a can being punctured thereby. Arranged on the plate 1*b* are rods 28, these rods being intended to bear against respective plates 27 as the plate 2*b* moves towards the fixed plate 1*b* during a compaction operation, the rods pushing against plates 27 to force the carrier 23 away from the plate 2*b*, thereby to withdraw the spikes 21 from the can. The extent to which the springs are compressed will be sufficient to permit the spikes to be fully withdrawn from the can, so that the can is able to fall freely through the free fall aperture. Instead of the illustrated arrangement of spikes 21 and rods 28, the spikes may be mounted immediately behind the fixed plate 1*b* and the can-release mechanism comprising rods 28 carrier 23 and springs 26 may be actuated by the moving plate. The spikes may be hollow or fluted so as to be able to conduct liquid therealong and may be arranged to communicate with suitable suction and drain means (not shown). Instead of two spikes, as shown, the can-piercing means may comprise only one spike arranged generally centrally of a respective compacting plate, or may comprise a greater number of spikes than shown, arranged in some suitable manner.

Figure 5:
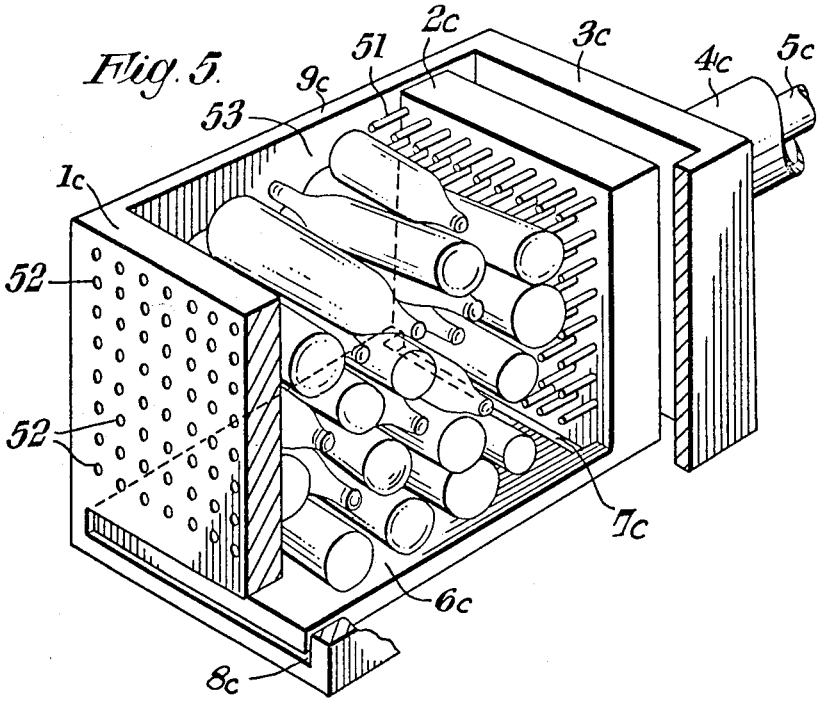
FIG. 5 illustrates the apparatus adapted for crushing bottles or like brittle objects.

FIG. 5 illustrates the manner in which a compacting apparatus according to the invention can be modified to crush bottles and like brittle objects. In this embodiment of the apparatus, the surface of the movable plate 2*c* facing the stationary plate 1*c* has arranged thereon a plurality of pegs 51, each of which is arranged to be received in a corresponding through-hole 52 in the plate 3*c* during a bottle crushing operation. The bottles, for example, are fed to the feed space 53 and, as the plate 2*c* advances, are crushed against the face of the plate 1*c*, the fragments falling out through the free-fall aperture 7*c* into a receptacle provided therefore. Any powdered glass which does not fall into the receptacle, but remains in the apparatus and tends to pack, so as to present an obstacle to the full working stroke of the moving plate 2*c*, will be forced by the pegs into and through respective holes 52, to fall away from the apparatus.

The side walls 9*c*, the fixed compaction plate 1*c*, the end wall 3*c* and the floor 6*c* form an open top box-like structure in which the bottles are contained during a crushing operation.

Figure 6:
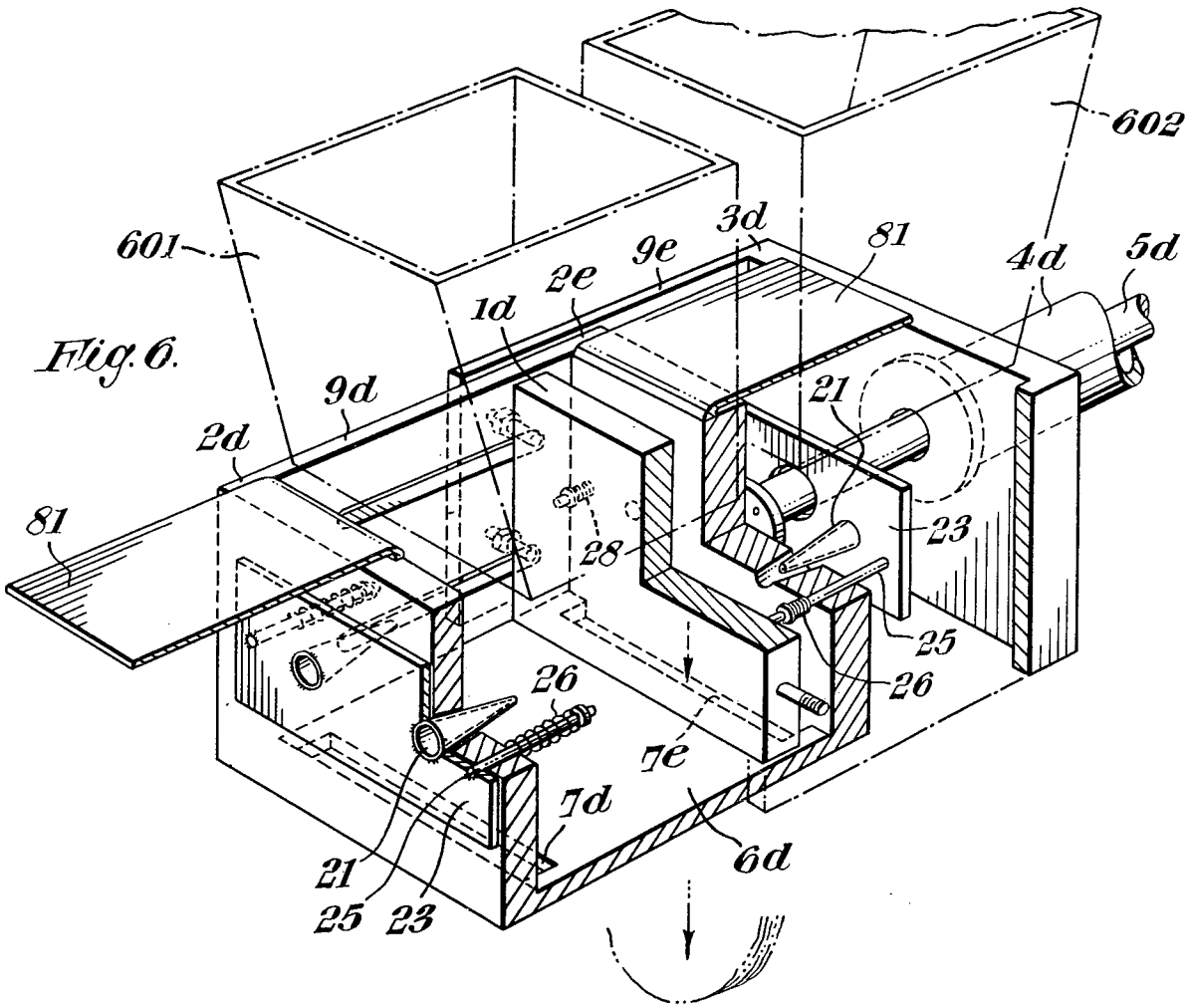
FIG. 6 illustrates two of the apparatus illustrated in FIG. 1 joined in tandem having two spaced apart, movable compacting plates and a stationary compacting plate intermediate of said spaced apart plates and common thereto.

FIG. 6 illustrates the manner in which two of the aforedescribed compacting apparatus can be joined in tandem to form a double-acting compactor, i.e. an apparatus which will compact in both directions of movement of the movable compacting plates 2*d* and 2*e*. In this embodiment the apparatus comprises two movable compacting plates 2*d* and 2*e* which are rigidly connected in spaced apart relationship by means of ties, which may have the form of side walls 9*d*. Arranged between the two movable plates 2*d* and 2*e* is a stationary compacting plate 1*d* which is connected to an end wall 3*d* and spaced therefrom, by means of the ties 9*d*, which may also have the form of side walls. Thus, the movable walls 2*d* and 2*e* together with side walls 9*d* and, when provided, the floor means 6*d* form a rigid movable compacting unit. It will be apparent from the Figure that when joining two of the aforedescribed compacting apparatus to form a tandem, or double-acting compacting apparatus only one stationary compacting plate 1*d* is required, this stationary compacting plate being common to both of the moving plates. The movable compacting unit is driven reciprocatingly by means of a piston-cylinder-arrangement 5*d*, 4*d* arranged at one end of the apparatus. In this instance the movable plate shown to the left of the Figure will be pulled towards the stationary plate 1*d* when the piston 5*d* is retracted in cylinder 4*d*, thereby to crush an object between the plates. The piston may be a differential piston or an equal-area piston. The cylinder is sealingly connected to the outer surface of the end wall 3*d* and is connected to a source of working medium (not shown), as are also the cylinders of the aforedescribed embodiments. As with the single-compacting apparatus described in FIGS. 1 and 2, the apparatus illustrated in FIG. 6 may be provided with a floor extending between the movable walls 2 and having a free-fall aperture located adjacent respective ones of said movable walls. The stationary wall 1*d* will then have arranged therein slots which allow the floor means to pass therethrough, or the wall may be provided with a groove in which the floor can slide. Alternatively the stationary wall 1*d* and the end wall 3*d* may be of a size such that the movable walls 2*d* and the floors therebetween are able to slide freely within the space defined by said fixed plate and said end wall.

As will be understood, the embodiment illustrated in FIG. 6 may have the supporting means illustrated in FIG. 3, with the floor 6*d* omitted as will be described in connection with FIG. 7.

As with the aforedescribed embodiment, the object to be compacted can be fed from a feeding device such as hoppers or chutes 601 and 602 into the respective spaces defined by respective movable walls 2*d* and 2*e* and the fixed wall 1*d* during a compacting operation, automatically by mechanically or electrically operated feeding and timing devices, or may be allowed to fall into said spaces gravitationally. An example of such a feeding device is a holding device having a mouth sufficiently large to accommodate the objects to be compacted, one at the time, and having a long axis extending parallel to the path moved by the compaction plates. In order to prevent said material from falling from a respective holding device whilst the compacting unit is carrying out a compacting stroke with respect to the other feed device, each movable plate 2*d* and 2*e* has extending outwardly from the top thereof and at an angle thereto a tail 81 against which said object can rest whilst the compacting plate associated with said tail is making a compacting stroke. The tails 81 are also arranged to close the spaces behind a respective compacting plate during a compacting stroke. Thus, as the plate 2*e* to the right of FIG. 7 is moved towards the fixed plate 1*d* its tail 81 will be moved across the mouth of the holding device, to prevent an object held therein from falling into the space between the opposing faces of the movable plate 2 and the end plate 3*d*.

Although the tandem compacting apparatus illustrated in FIG. 6 is shown to be driven by means of a double-acting piston cylinder arrangement, it will be understood that the unit can equally as well be driven by any other suitable prime mover. Furthermore, a drive means may be arranged at respective ends of the movable compacting unit and connected to a respective one of the two plates 2*d* and 2*e*, in a manner such as to provide a force of equal magnitude over an equal time period in the compacting direction of said plates 2*d* and 2*e*.

Figure 7:
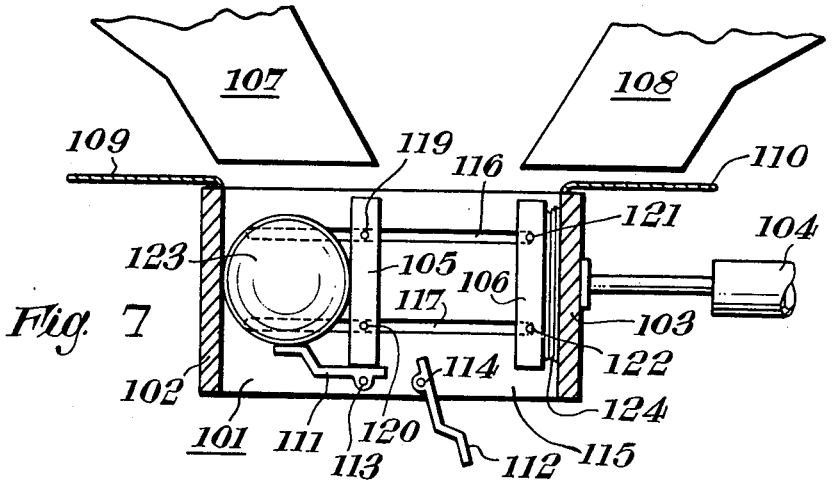
FIG. 7 is a side elevation of an apparatus similar to FIG. 3 in partial section.

FIG. 7 shows in sectional side elevation an embodiment of double-acting compaction apparatus having no fixed support floor.

A movable compaction assembly 101 having end walls 102 and 103 is reciprocated by a double-acting piston and cylinder arrangement 104. Within assembly 101 are provided two stationary compaction plates 105 and 106. As will be apparent, a can may be crushed between end wall 102 and plate 105 in a first crushing chamber or between end wall 103 and plate 106 in a second crushing chamber. When in operation, cans are crushed alternately in both crushing chambers. Thus, a can is crushed on each stroke of the piston of arrangement 104. Two feed means 107 and 108 are positioned to supply cans to respective crushing chambers. To prevent a can falling from feed means 107 and 108 to the outside of assembly 101, each end wall 102 and 103 is provided with a respective tail 109 and 110 for shutting off supply from the feed means 107 and 108 automatically in the correct sequence. For support of a can in either crushing chamber, the chambers are provided with respective pivotable support devices 111 and 112, pivoted on axes 113 and 114 respectively. These devices 113 and 114 are supported between the side walls of assembly 101, only one side wall 115 being shown. Device 113 and 114 are automatically pivoted to and from their respective supporting positions by the lower edge of respective plates 105 and 106 as the assembly 101 is reciprocated.

For firm anchoring of plates 105 and 106, slots 116 and 117 are provided in side wall 115 and also in the other side wall (not illustrated). Bolts 119 and 120 pass through respective slots 116 and 117 to secure plate 105 and similarly bolts 121 and 122 secure plate 106.

A can 123 is shown in the left hand crushing chamber supported by device 111 in a position for side ways crushing. A crushed can 124 is shown between wall 103 and plate 106. As assembly 101 moves rightwards from the illustrated position, can 124 will fall from the apparatus and can 123 will be crushed.

Figure 8:
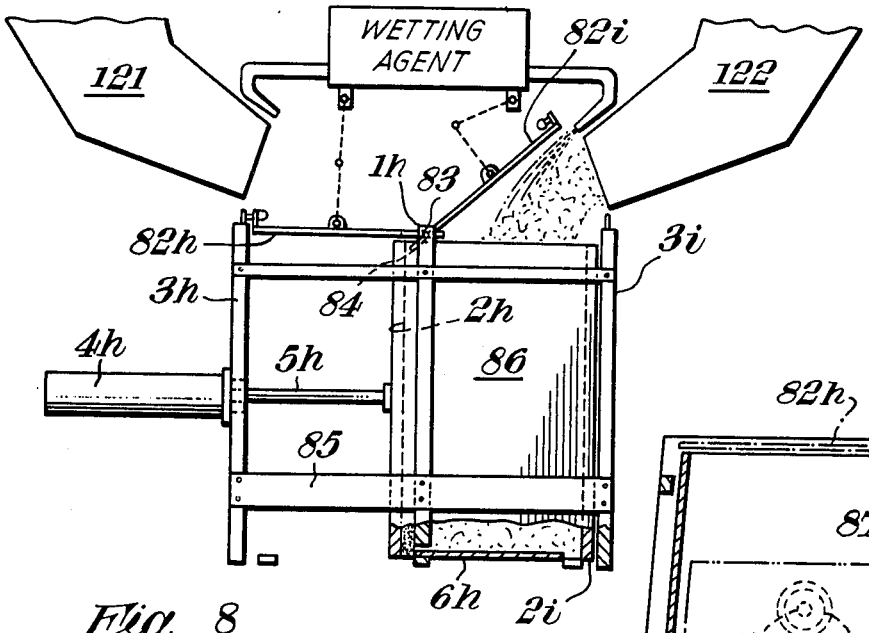
FIG. 8 illustrates an apparatus for compacting a plurality of objects charged to the apparatus in random array.
Figure 9:
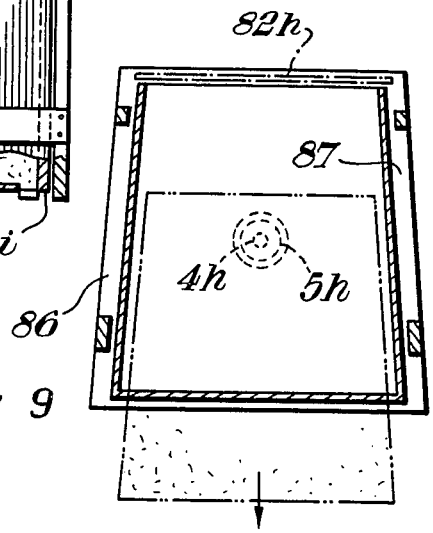
FIG. 9 is a transverse partial section through the apparatus of FIG. 8.

In FIGS. 8 and 9 there is illustrated a double-acting or tandem compacting apparatus intended for the in situ compaction of a large number of cans or the compaction of a mass of material such as sewage tailings, domestic waste, factory waste and like waste bulk material supplied from feed means 121 and 122. The apparatus comprises a movable compacting unit having two spaced apart movable plates 2*h* and 2*i* tied together by means of walls 86 and 87 (not shown) and floor means 6*h* with free-fall apertures arranged therein, in the manner of the compacting aparatus hereinbefore described. The apparatus further comprises a stationary compacting unit, having a fixed compacting plate 1*h* which is spaced from and tied to a fixed end wall 3*h*. Sealingly connected to the end wall 3*h* is cylinder 4*h* of a piston-cylinder-arrangement, one end of the piston 5*h* of said arrangement being connected to one of the movable plates 2*h* and 2*i*. Side walls 86 and 87 contain the material to be compacted within respective compaction spaces. These walls extend between the movable plates 2*h* and 2*i* in a manner suitable to form an open-top box-like structure into which the material to be compacted can be charged from means 121 or 122, the height of the side walls depending upon the material to be compacted. When the material contains water, the side walls are provided with drainage means or are made of a strong, porous material. Preferably, the side walls will have the same height as the compacting plates. The unit comprising plates 2*h* and 2*i* and side walls 86 and 87 preferably arranged to move within the fixed unit formed by plates 1*h*, 3*i* and 3*h* with the plate 1*h* between the movable plates 2*h* and 2*i*. There is nothing to prevent the unit from moving outside the fixed plate, however, with the walls 86 and 87 sliding against the outer edges of the fixed plate 1.

As shown in FIG. 9, the compacting plates have a trapezoidal configuration, with the shorter of the two parallel sides of the plates at the top thereof in the in-use position of the plates.

As shown, each of the loading spaces formed as respective plates 2*h* and 2*i* move towards and away from the fixed plate 1 is covered by one of hinged lids 82*h* and 82*i*. Each of the lids is pivotable about a commmon pivot axis 83 arranged in the neighbourhood of the top of the plate 1*h* and has a release portion 84 which extends across the stationary plate, to protrude into the spaces covered by the other of said lids. To facilitate pivoting of respective lids about the common pivot axis 83, the pivot edges of respective lids adjacent said axis are provided with tongues and apertures which are received in and which receive respectively similar tongues and apertures arranged in the pivot edge of the other of the lids, the tongues of respective lids forming said protruding release portions.

When compacting a multiplicity of objects, such as cans or bottles, or a large mass of waste material, such as sewage, the free-fall apertures should be held closed unitl a compaction stroke is completed or is near completion. This can be effected by shutter means arranged to open and close respective aperture means in a time controlled manner. For example, each aperture may be closed by a sliding or hinged plate actuated by suitable linkage means, e.g. by arms attached to a part of the side walls 86 and 87, and to said shutters in a manner such that the arms will open and close the shutters at a given location along the path of movement of the movable plates.

Thus, in operation, material to be compacted is charged to the loading space between a respective one of movable plates 2*h* or 2*i* and the fixed plates 3*h* or 3*i*, with free-fall aperture closed-off by the shutter means. The plate 2*h* or 2*i* is then driven towards the plate 1*h*, to compact said material, which may be sewage waste. As the plate nears the completion of its compaction stroke or upon completion of said stroke the associated free-fall aperture is automatically uncovered by the aforesaid linkage mechanism. The compacting plate is then withdrawn slightly, e.g. a distance of 10 mm, to release the pressure on the compacted mass. The lid 82*h* or 82*i* of the loading space now formed between the other of the movable plates 2*h* or 2*i* and said fixed plate 1*h* is now lifted, to permit waste to be loaded into said space. As this lid is raised, the release portion 84 of said lid will be moved down to engage the top of the material just compacted and urge it downwardly, thereby breaking any frictional forces acting between the compacting material and the faces of plates 1*h* and 2*h* or 2*i*. Since the plates are of a trapezoidal configuration, and the space in which the compacted material is confined flares outwardly at the bottom, the compacted material is able to fall quite freely through the free-fall aperture.

Further, the lids may be arranged to cooperate with means for disconnecting the apparatus from its power source if a lid is lifted prior to the completion of a compaction stroke. Such means may have the form of micro switches.

The lids may also be arranged to cooperate with automatic lid-opening and lid-closing means, such that the apparatus can be charged fully automatically. When the material to be compacted is dry and not readily compactable, a wetting agent may be added, which reduces the resistance to compaction, said agent being optionally mixed with a binder.

When compaction is to be carried out on a factory scale, for example, a multiplicity of double or single acting compactors may be connected in side-by-side and/or in-line relation. In this case the movable compacting plates of adjacent apparatus will be attached to a common beam or bar to which one end of the prime mover is connected.

What we claim as our invention and desire to secure by Letters Patent of the United States is:

1. A double-acting compacting apparatus comprising a first compacting plate; a second compacting plate attached to and spaced from said first compacting plate; a third, stationary compacting plate arranged between said first and said second compacting plates; means for mounting said first compacting plate and said second compacting plate for movement relative to said third compacting plate; drive means for providing movement of said first and said second plates relative to said third plate; means for providing a free-fall aperture such that compacted matter can automatically fall freely from the apparatus upon completion of a compaction stroke; feed means for feeding matter to be compacted alternately to respective spaces formed between respective ones of said first and said second compacting plate and said third compacting plate during said movement; and means for covering each of said spaces while compaction is occurring therein and for uncovering each of said spaces for receiving said matter while compaction is occurring in the other space.

2. An apparatus according to claim 1 wherein the material to be compacted is a liquid-filled can, and wherein one of said plates is provided with retractable can-piercing means.

3. An apparatus as claimed in claim 2, wherein the can-piercing means comprises a spring-biased piercing member retractably mounted on said one of said plates.

4. An apparatus according to claim 1 wherein said means for providing a free-fall aperture includes a pivotable support member arranged for movement between a first position in which it lies in the free-fall path of material to be compacted, to support said material in said path, and a second position in which it lies outside said free-fall path.

5. An apparatus as claimed in claim 4, wherein said pivotable support member is pivotable about an axis located beneath the bottom edge of the movable plate in the starting position of said plate, and wherein the apparatus includes means contacting said movable plate for holding said support member in its supporting position before a compaction stroke commences such that said member is free to pivot during said compaction stroke, and is moved back to said supporting position by said plate upon the return stroke thereof.

6. An apparatus according to claim 1 wherein the stationary compacting plate is rigidly connected to an end plate located externally of one of said first and said second compacting plates.

7. An apparatus according to claim 1 wherein said compacting plates have a substantially trapezoidal configuration, with the shorter of the parallel sides of said plates being located at the top thereof when in use.

8. An apparatus according to claim 1 and including means for automatically closing and opening an associated free-fall aperture at predetermined locations along a movement path of a movable compacting plate.

9. An apparatus according to claim 8 in which the material to be compacted is not readily compactable, dry bulk waste material, and including means for wetting said material with a substance to facilitate the compaction thereof.

10. An apparatus as claimed in claim 9, wherein the wetting agent is a water-bound adhesive.

11. An apparatus according to claim 1 wherein said means for covering comprises a support surface extending outwardly away from said third plate from the top of each of said first and second plates, against which support surface matter fed from said feed means can be supported in readiness to be fed to a respective one of said spaces.

12. An apparatus as claimed in claim 1 wherein said means for covering comprises pivotable lid means having means thereon for initiating the free fall of compacted materal through an associated free fall aperture.

13. An apparatus as claimed in claim 12 wherein said lid means are pivotable about a common axis located on the top edge of the fixed compacting plate and extending substantially parallel with said top edge; wherein the edges of said lid means adjacent said common axis protrude into a respective one of the adjacent loading spaces in a manner such as to be pivotable about said axis and wherein said protruding portions of said lid ends form said free-fall initiating means.

* * * * *